US011376583B2

(12) United States Patent
Faltin et al.

(10) Patent No.: US 11,376,583 B2
(45) Date of Patent: Jul. 5, 2022

(54) MICROFLUIDIC DEVICE AND METHOD FOR ANALYSING SAMPLES

(71) Applicant: Robert Bosch GmbH, Stuttgart (DE)

(72) Inventors: Bernd Faltin, Gerlingen (DE); Jochen Rupp, Stuttgart (DE); Juergen Steigert, Stuttgart (DE); Christian Dorrer, Winnenden (DE); Karsten Seidl, Mülheim an der Ruhr (DE)

(73) Assignee: Robert Bosch GmbH, Stuttgart (DE)

( * ) Notice: Subject to any disclaimer, the term of this patent is extended or adjusted under 35 U.S.C. 154(b) by 390 days.

(21) Appl. No.: 16/348,673

(22) PCT Filed: Oct. 26, 2017

(86) PCT No.: PCT/EP2017/077471
§ 371 (c)(1),
(2) Date: May 9, 2019

(87) PCT Pub. No.: WO2018/086903
PCT Pub. Date: May 17, 2018

(65) Prior Publication Data

US 2019/0262832 A1 Aug. 29, 2019

(30) Foreign Application Priority Data

Nov. 10, 2016 (DE) ..... 10 2016 222 035.7

(51) Int. Cl.
*B01L 3/00* (2006.01)
*B01L 7/00* (2006.01)

(52) U.S. Cl.
CPC ..... *B01L 3/502715* (2013.01); *B01L 7/525* (2013.01); *B01L 2300/0654* (2013.01); *B01L 2300/0816* (2013.01)

(58) Field of Classification Search
CPC ..... B01L 2300/0654; B01L 3/502715; B01L 7/525; B01L 2300/0816
See application file for complete search history.

(56) References Cited

U.S. PATENT DOCUMENTS

| | | | |
|---|---|---|---|
| 2006/0228812 A1 | 10/2006 | Higashino et al. | |
| 2006/0246493 A1 | 11/2006 | Jensen et al. | |
| 2007/0243634 A1 | 10/2007 | Pamula et al. | |
| 2017/0113221 A1* | 4/2017 | Hoffman | B01L 3/502715 |

FOREIGN PATENT DOCUMENTS

| | | |
|---|---|---|
| DE | 10 2010 031 212 A1 | 1/2012 |
| DE | 10 2011 078 770 A1 | 1/2013 |
| EP | 3 032 251 A1 | 6/2016 |
| WO | 01/08799 A1 | 2/2001 |
| WO | 2008/143646 A2 | 11/2008 |
| WO | 2015/191916 A1 | 12/2015 |

OTHER PUBLICATIONS

International Search Report corresponding to PCT Application No. PCT/EP2017/077471, dated Jan. 2, 2018 (German and English language document) (7 pages).

* cited by examiner

*Primary Examiner* — Shogo Sasaki
(74) *Attorney, Agent, or Firm* — Maginot, Moore & Beck LLP

(57) ABSTRACT

A microfluidic device for analyzing samples includes at least two fluidic pathways for receiving samples and at least one capture area. The at least one capture area is configured for a detection unit for measuring light, and is configured to capture light emitted from samples in the at least two fluidic pathways, across the capture area.

6 Claims, 1 Drawing Sheet

MICROFLUIDIC DEVICE AND METHOD FOR ANALYSING SAMPLES

This application is a 35 U.S.C. § 371 National Stage Application of PCT/EP2017/077471, filed on Oct. 26, 2017, which claims the benefit of priority to Serial No. DE 10 2016 222 035.7, filed on Nov. 10, 2016 in Germany, the disclosures of which are incorporated herein by reference in their entirety.

BACKGROUND

The disclosure relates to a microfluidic device and a method for analyzing samples.

A microfluidic device is known from DE 102011078770 A1. The microfluidic device comprises in particular channels that are fluidically connected with one another. The microfluidic device is suitable in particular for transport and analysis of fluids.

Moreover, a multilayer system composed of a plurality of metal layers, as well as a production method for producing such a multilayer system, are known from DE 102010031212 A1.

SUMMARY

Based on this, a microfluidic device with a method and a system is disclosed herein. Advantageous further developments and improvements of the microfluidic device and the method are possible by means of the features specified in the respective dependent claims.

A microfluidic device for analyzing samples is proposed that comprises at least two fluidic pathways for receiving samples and at least one capture area for a detection unit for measuring light, which is configured to capture light emitted from samples in the at least two fluidic pathways over the capture area.

The term "microfluidic" refers here primarily to the size of the microfluidic device. The microfluidic device is characterized in that in the fluidic channels and chambers arranged therein, relevant physical phenomena occur that are ordinarily classified in the field of microtechnology. For example, these phenomena include capillary effects, i.e. effects (in particular mechanical effects) connected with the surface tension of the fluid. They also include further effects such as thermophoresis and electrophoresis. In microfluidics, these phenomena are ordinarily dominant relative to effects such as gravity. The microfluidic device can also be characterized in that it is at least partially produced by means of a layered method and in that channels are arranged between the individual layers of the structure. The term "microfluidic" can also refer to the cross-sections within the device that are used to guide the fluid. For example, cross-sections in the range of 100 μm [micrometers]×100 μm up to 800 μm×800 μm are common.

In particular, the microfluidic device can be a so-called lab on a chip. Such a lab on a chip is designed and configured to carry out biochemical processes. This means that the functions of a macroscopic laboratory can be integrated for example into a plastic substrate. The microfluidic device can for example comprise channels, reaction chambers, upstream reagents, valves, pumps, and/or actuation, detection and control units. The microfluidic device can make it possible to carry out biochemical processes fully automatically. For example, this allows tests to be conducted on liquid samples. Such tests can be used in fields such as medicine. The microfluidic device can also be referred to as a microfluidic cartridge. In particular, samples can be input into the microfluidic device in order to carry out biochemical processes therein. The samples can also be mixed with additional substances that trigger, accelerate and/or allow biochemical reactions. An evaluation can be conducted by means of the detection unit by placing the microfluidic device in such a way that the detection unit can cover at least the capture area (i.e. in particular can receive light emitted from the capture area). The detection unit is not a component of the microfluidic device. In particular, the microfluidic device can be filled with samples independently of the detection unit.

The microfluidic device is described by way of example by means of molecular diagnostic detection methods. Further fields of application of the microfluidic device can for example be in the area of immunology or clinical chemistry. In particular, the microfluidic device can be used for in vitro diagnosis.

The microfluidic device is preferably configured and designed in particular to analyze nucleic acids. This can in particular comprise an analysis of DNA. The microfluidic device can in particular facilitate the conduct of a plurality of different analysis and/or detection methods. In particular, the microfluidic device can allow a plurality of analysis and/or detection methods to be carried out simultaneously (or sequentially) and/or in combination. In particular, different analysis and/or detection methods can be carried out in different areas of the microfluidic device or in different areas of the fluidic pathways.

The microfluidic device is configured and designed to receive samples in the fluidic pathways. A sample can be divided among a plurality of fluidic pathways. Alternatively, a plurality of different samples can be separately received in the different fluidic pathways. The microfluidic device preferably comprises a microfluidic network (which in particular is formed by the fluidic pathways). Particularly preferably, the microfluidic network is configured to be highly integrated. This means that extensive functionality is possible in a small space. The microfluidic device preferably comprises pumps, valves and control devices that are designed and configured to guide samples into and/or through the fluidic pathways. In particular, the microfluidic device can be used for different applications by means of different settings of the valves.

The fluidic pathways are preferably at least essentially separated from one another. This means that fluids and other substances do not come into contact and/or are not mixed with one another in the individual fluidic pathways, at least with the exception of individually desired interfaces at which mixing is explicitly desired and purposely elicited. For example, a plurality of fluidic pathways can be brought together in a joint reaction chamber (the joint reaction chamber then constitutes an interface between the individual fluidic pathways). In this case, the fluidic pathways are separated from one another, with the exception of openings in this joint reaction chamber. The fluidic pathways can also be completely separated from one another. In this case, there is no interface between different fluidic pathways.

The fluidic pathways are preferably further thermally separated from one another, so that the sample (parts) in the different fluidic pathways can be at different temperatures. Preferably, the temperature of the individual fluidic pathways can be individually set. It is also preferable for radiation barriers to be provided between the fluidic pathways. This makes it possible in particular to couple external radiation (e.g. for excitation purposes) onto a fluidic pathway or to couple it in a locally limited manner.

The detection unit preferably comprises a sensor, in particular an optical sensor. The optical sensor is preferably configured to detect electromagnetic radiation (in particular light) and to convert it into an electronic signal. Preferably, the detection unit is configured to carry out measurement in a temporally and spatially resolved manner and to generate a temporally and spatially resolved measurement signal.

Furthermore, the detection unit preferably comprises a signal processing unit for electronic processing of the received signal and a signal reproduction unit for visual display of the received and processed signal. The signal processing unit is preferably configured as a computer (in particular comprising a computer processor). Preferably, the signal reproduction unit comprises a display screen. Alternatively, it is preferable for the detection unit to have only one port that emits an electronic signal that is suitable and designed for processing by a signal processing unit and subsequent display by a signal reproduction unit. For example, a computer can be connected to the port.

The detection unit is preferably designed in particular to be especially suitable for detecting light of a wavelength that is emitted by samples in the microfluidic device or light of a wavelength that would be expected to be emitted by a sample typically examined in the microfluidic device when the sample undergoes a specified test method. This light can in particular be characterized by electromagnetic waves with a wavelength in the range of 150 to 900 nm [nanometers], in particular in the range of 300 to 700 nm. In particular, the light can be light that is visible (to humans).

The light can be emitted by the samples as a result of biochemical processes. The samples can also be at least partially converted by biochemical processes into a substance that can emit light. Furthermore, substances can also be released by biochemical processes that are capable of emitting light. In particular, the light can be emitted due to fluorescence. Preferably, the microfluidic device is configured such that external excitation of the samples or a substance formed or released by biochemical processes is possible. This allows fluorescence to be excited in a particularly strong manner and to be particularly favorably measured.

The biochemical processes can in particular be processes ordinarily carried out for analysis of nucleic acids (or DNA). In particular, suitable analysis methods include (real-time) amplification, melting curve analysis and microarray analysis.

Amplification refers in particular to the proliferation of DNA by means of an enzyme (such as e.g. polymerase). Fluorescent substances can be released in this process. The extent of the amplification can be determined by measuring the fluorescent light. This means that the light intensity and/or spatial expansion of a light signal can provide information on the degree of proliferation of the DNA. Preferably, all of the light emitted from the sample is detected, in particular over the entire expansion of the sample. Alternatively, a representative section of the sample can be observed.

Representative means that only a part of the sample is measured, wherein the measured values can be converted to apply to the entire sample. In a representative section of a sample, a value measured for a non-scalable property preferably corresponds to an average value for the entire sample. A non-scalable property does not depend on the amount of the sample observed, as does density for example. In addition, a value measured on a representative section of the sample for a scalable characteristic (such as e.g. mass) corresponding to the portion of the section in the entire sample is smaller than the value of this property that is measurable for the entire sample.

If the light is measured in real time, the amplification can also be referred to a real-time amplification. By means of real-time amplification, the course of the amplification over time can be detected. In particular, a quantitative degree of DNA proliferation can be detected by means of (real-time) amplification. For example, the real-time amplification can be a so-called "real-time polymerase chain reaction (real-time PCR)". The term chain reaction means that a product of an amplification reaction can in turn be the starting substance for a new amplification reaction.

As (real-time) amplification with the described microfluidic device can take place in different fluidic pathways that are separated from one another, one can also speak of multiwell (real-time) amplification. Multiwell (real-time) amplification is preferably carried out in a multiwell chamber of the microfluidic device in which a plurality of recesses (the wells) is provided. The multiwell chamber preferably has a volume in the range of 5 μl to 50 μl [microliters], in particular in the range of 10 μl to 25 μl. Each of the recesses preferably has a volume in the picoliter or nanoliter range.

The melting curve analysis can in particular comprise heating of DNA. In this process, a characteristic temperature of a fluorescent substance can be emitted. The characteristic temperature can for example allow identification of a DNA fragment. DNA can be identified by measuring an intensity of fluorescent light against a temperature (which in particular is increased in a continuous and controlled manner). As is the case for (real-time) amplification, it is also preferable in the melting curve analysis that light emitted by the sample can be detected over the entire extension of the sample.

For the microarray analysis, one can in particular use a microarray (i.e. an arrangement of columns and rows with structures in the micrometer range) composed of multiple test cells. In particular, several thousand test cells can be arranged in a microarray. The various test cells can be provided with different (known) test substances, in particular using automated devices. Addition of a sample to the microarray can result in the hybridization (i.e. accumulation) of components of the sample and different test substances. In this process, emission of fluorescent light or the release and/or formation of fluorescent substances may occur. The sample can also be provided with a fluorescent agent so that the emission of fluorescent light indicates the presence of (a component of) the sample in a specified test cell. Components of the sample can be identified by determining in which test cells (i.e. by which test substance) the emission of fluorescent light occurs.

The microarray analysis can also be carried out simultaneously with two or more samples. For example, a first sample can be mixed with a first fluorescent agent and a second sample with a second fluorescent agent. If the light emitted by the first and the second fluorescent agents differs in wavelength (i.e. in color), the two samples can be simultaneously analyzed by wavelength-selective measurement of the light. Such microarray analysis with different samples can for example be used to compare two samples, in particular healthy and diseased cells. Using the microfluidic device described, one can carry out a comparison within a closed system (i.e. within the microfluidic device), thus allowing errors to be reduced.

In the microarray analysis, spatially resolved measurement of the emitted light is preferred, in particular with a resolution that allows evaluation of the individual test cells (i.e. determination that a pixel of a measurement signal is at least smaller than a test cell). Preferably, the resolution is at least high enough to allow a test cell with at least ten pixels to be displayed.

The described analysis methods are preferably carried out in combination with one another. For example, it is preferable to first carry out amplification (in particular under quantitative measurement of a degree of proliferation in real time) and then to qualitatively test the DNA present in a greater amount by means of microarray analysis or identify the components of the DNA in a sample. Using the described microfluidic device, one can in particular carry out the described analysis methods. This can in particular be carried out simultaneously or in immediate succession. In particular, the microfluidic device is preferably configured such that the capture area for the detection unit comprises a part of the microfluidic device that is configured and designed for the carrying out (in parallel) of different analysis methods.

With the detection unit, it can be possible in particular to detect the total intensity of emitted light within the capture area (such as e.g. the light required for (real-time) amplification and melting curve analysis). Here, total intensity means that all of the light emitted by the samples within the capture area is detected as a sum total. The light intensity is thus integrated across the capture area. It can also be possible to determine intensity not for the entire capture area, but only for a portion thereof. This can in particular be advantageous for detecting light emitted by one of the fluidic pathways (or by a part of one of the fluidic pathways, in particular e.g. a reaction chamber). In this case, it is possible with the detection unit to carry out (real-time) amplification for two fluidic pathways separately and simultaneously wherein quantitative data on a degree of proliferation of DNA in the respective fluidic pathways can be obtained. If one then for example carries out a microarray analysis (e.g. in a reaction chamber that can be filled with samples from two otherwise separate fluidic pathways and is also arranged within the capture area of the detection unit), then the same detection unit can be used for the microarray analysis. Spatially resolved detection of emitted light is preferred for the microarray analysis.

This means that on the one hand, spaces for different processes are preferably provided (e.g. for a plurality of separate (real-time) amplifications and for a microarray analysis). On the other hand, it is preferable for spatially resolved detection of emitted light to be possible. In this case, the detection unit can in particular be inexpensively configured if one either covers only a particularly large capture area or achieves only particularly high spatial resolution. High spatial resolution over a large capture area can only be achieved by means of considerable (cost) expense. The microfluidic device described here provides the advantages of being configured in a particularly small space. This makes it possible to carry out, within the capture area of the detection unit, both a plurality of separate (real-time) amplifications, for example, as well as a microarray analysis, wherein the spatial resolution is sufficient in particular for the microarray analysis. This can in particular save on the costs of the detection unit (because a particularly high-resolution detection unit is not required), or one can dispense with the use of a plurality of detection units.

The capture area preferably has an area of 200 to 2000 $mm^2$ [square millimeters], in particular an area in the range of 500 to 1500 $mm^2$. For example, the capture area can be configured as a square measuring 30 mm by 30 mm [millimeters]. The position of the capture area in the microfluidic device can vary. This means that by displacing the microfluidic device relative to the detection unit, the capture area can be displaced on the microfluidic device.

The division among a plurality of fluidic pathways allows biochemical processes to be carried out separately from one another. In particular, reactions among different samples or components of a sample can be inhibited in order to achieve more robust process control. Such reactions among (components of) samples in different fluidic pathways can also be referred to as cross-reactions. Cross-reactions are undesirable and constitute a hindrance in most applications. For example, undesired reactions can occur with a high degree of multiplexing of more than four primer pairs (e.g. in particular 6 to 60 primer pairs) or in parallel RNA and DNA amplification.

Division among the fluidic pathways can also allow processing time to be reduced, in particular without loss of quality. This is the case for example in the embodiment in which RNA amplification is carried out in a first fluidic pathway and DNA amplification is carried out in a second fluidic pathway. By dividing the samples among different fluidic pathways, the degree of complexity of a (chemical or biochemical) reaction, in particular a multiplex reaction, can be reduced. This can reduce reaction and/or processing times.

Furthermore, division among the fluidic pathways can make it possible to carry out different analyses at different times and/or at least to evaluate different analyses at different times. This makes it possible in particular to combine analyses that have different durations. Provisional or intermediate results can also be determined. The samples can be further processed following a provisional or intermediate result. Optionally, a plurality of provisional or intermediate results can also be determined between different process steps.

Reference and target molecules of an analysis can also be separately processed. In particular, the reference and target molecules can be analyzed using only one wavelength of (fluorescent) light.

In a preferred embodiment of the microfluidic device, the detection unit is provided with a camera.

The camera can for example be configured as a CCD or CMOS camera or comprise a CCD or CMOS chip. Preferably, the camera is configured to cover the capture area of the microfluidic device in a spatially resolved and large-area manner (i.e. to detect light emitted from the capture area, in particular by samples in the microfluidic device). The camera is most particularly preferably configured for the detection of fluorescence, chemiluminescence and/or bioluminescence. Preferably, the camera is sensitive in particular to electromagnetic radiation (i.e. in particular light) having wavelengths in the range of 150 to 900 nm [nanometers], in particular in the range of 300 to 700 nm.

In a further preferred embodiment, the microfluidic device has a coupling area for coupling an impulse emitted by the excitation device into the samples.

The excitation device is preferably a source of radiation, in particular electromagnetic radiation. Preferably, the excitation device is configured to emit electromagnetic radiation with a wavelength in the range of 150 to 900 nm [nanometers].

Preferably, the excitation device is a heat source. Particularly preferably, the excitation device comprises a laser. The laser is preferably configured for fluorescence excitation (in particular within the samples). The excitation device is not a component of the microfluidic device.

An action of the excitation device on the samples is possible over the (entire) coupling area, wherein the action need not be exerted simultaneously at all locations of the coupling area. The coupling area is the area in which the action can be exerted. The coupling area of the excitation device preferably overlaps with the capture area of the detection unit. In particular, it is preferable for the coupling area of the excitation device and the capture area of the detection unit to be (completely) congruent.

In an embodiment, the excitation device is configured to act with electromagnetic radiation of one or more (discrete) wavelengths on the samples in the microfluidic device, or to couple such electromagnetic radiation into the samples in the microfluidic device. In particular, fluorescence can be produced within the samples by means of such an action or coupling.

In particular, in (real-time) amplification, multiwell real-time amplification and melting curve analysis, excitation, i.e. excitation of the sample, is preferably carried out. A microarray analysis is also preferably carried out under excitation. Alternatively, however, a microarray analysis can also be carried out in an autofluorescent manner (i.e. without external excitation).

It is also preferable for the excitation to take place via an excitation light, and in particular via a filter system (in particular for adjusting an excitation wavelength).

In a further preferred embodiment of the microfluidic device, at least one chamber for receiving at least part of the sample is provided in each of the fluidic pathways.

The chamber can for example be a process or reaction chamber for carrying out a (bio)chemical reaction, an amplification chamber for carrying out (real-time) amplification, a detection chamber for measurement (in particular of fluorescence and in particular by means of the detection unit), a mixing chamber for mixing a sample with a (test) substance and/or a storage chamber for (intermediate) storage of a sample, a reaction (intermediate) product or a (test) substance. A chamber can also be used simultaneously or successively for a plurality of different purposes. Each of the chambers can be divided into a plurality of cells in order to form a microarray for microarray analysis.

In an embodiment, an amplification chamber (i.e. a chamber in which amplification can take place) is arranged for DNA and/or RNA amplification in such a way that the entire amplification chamber, or at least a representative portion thereof (e.g. measuring 2 mm by 2 mm [millimeters]) is located in the capture area of the detection unit. This makes it possible to directly carry out and acquire in the amplification chamber melting curve analysis or (real-time) amplification. In particular, it is preferable for the at least two fluidic pathways to be arranged such that amplification chambers of all of the pathways are all arranged in the capture area of the detection unit.

Also preferred is an embodiment in which the detection chamber is (fluidically) connected to an amplification chamber so that a sample can be transferred from the amplification chamber into the detection chamber. In particular, it is preferable for the detection chamber to be located within the capture area of the detection device.

Preferably, it is possible for the chambers to be heated in particular to between 25° C. and 100° C., and preferably even to between 15° C. and 100° C. In particular, it is preferably possible for the chambers to be individually heated to independent temperatures. Cooling and/or heating means are preferably provided for cooling and/or heating of the chambers. The heating means can for example be heating wires for generating resistive heat or radiation sources for generating radiative heat. The cooling means can for example be cooling lines for a cooling medium.

The chambers are preferably arranged on the same level. Alternatively, it is preferable for the chambers to be arranged in a plurality of levels, which in particular are arranged parallel to the capture area (or a surface of the microfluidic device).

In a further preferred embodiment, the microfluidic device further comprises an end chamber that is connected to the at least two fluidic pathways. The end chamber can also be divided into a plurality of cells in order to form a microarray for microarray analysis.

The end chamber can for example be a process or reaction chamber for carrying out a (bio)chemical reaction, an amplification chamber for carrying out (real-time) amplification, a detection chamber for measurement (in particular of fluorescence and in particular by means of the detection unit), a mixing chamber for mixing a sample with a (test) substance and/or a storage chamber for (intermediate) storage of a sample, a reaction (intermediate) product or a (test) substance. The end chamber can also be used simultaneously or successively for a plurality of different purposes. It is also preferable for the end chamber to be configured as the multiwell chamber described above.

The end chamber is preferably connected to the at least two fluidic pathways in such a way that the samples can be fed from the fluidic pathways into the end chamber and mixed there. It is preferable for there not to be any connection among the fluidic pathways (i.e., for them to be separated from one another), with the exception of an indirect connection of the fluidic pathways via the end chamber.

A microarray is preferably provided in the end chamber. Preferably, the end chamber is completely within the capture area of the detection unit. Alternatively, at least the microarray is (completely) within the capture area.

In an embodiment, (real-time) amplification (e.g. in the form of real-time PCR) takes place upstream of microarray analysis. The (real-time) amplification can be carried out in one or a plurality of the fluidic pathways (in particular separately from one another), while the microarray analysis is preferably carried out in the end chamber. For this purpose, the reaction product or reaction products of the (real-time) amplification can be mixed with a hybridization buffer, pumped into the end chamber (which in this case serves as an analysis chamber) and hybridized in the end chamber. This method is advantageous in that by means of the (real-time) amplification, one can both generate quantitative data and carry out multiplex detection via detection on the microarray.

The microfluidic conversion in the fluidic pathways, which end in the end chamber, can allow surface-tight conversion in a plurality of areas separated from one another (in particular within different chambers), in particular within the capture area of the detection unit.

As a further aspect, a method is provided for analyzing samples using a microfluidic device as described above, comprising at least the analysis of nucleic acids, wherein in each case of analysis different analysis methods are carried out in different fluidic pathways of the device.

The above-described particular advantages and design features of the microfluidic device are applicable and transferable to the described method.

The fact that the method comprises at least the analysis of nucleic acids means that at least two analysis methods are carried out that can take place successively or (at least partially) simultaneously. The at least two different analysis methods can also be carried out at different locations or (at least in the case of the analysis methods carried out successively) at a single location of the microfluidic device.

Furthermore, the at least two different analysis methods can be carried out with the same sample (or with the same part of a sample) or, however, also with different samples. In the latter case, it is preferable for there to be an interaction between the different samples. This can for example mean that two samples are first separately treated, each after a respective analysis method, wherein a joint analysis is then carried out, with the two samples being mixed together for this purpose.

Preferably, a sample is divided among a plurality of fluidic pathways. Alternatively, it is preferable to separately take up a plurality of different samples in the different fluidic pathways. It is also preferable to first divide a sample among a first plurality of fluidic pathways and then take up a second sample in a further fluidic pathway or divide it among a second plurality of fluidic pathways.

The configuration of the microfluidic device with two pathways makes it possible to carry out two analysis methods, using two different samples, with a microfluidic device.

In a preferred embodiment of the method, the at least two analysis methods are selected from the following group:

(real-time) amplification,
endpoint amplification,
melting curve analysis and
microarray analysis.

In (real-time) amplification, a polymerase chain reaction (PCR) is preferably carried out. The term endpoint amplification refers in particular to amplification in which measurement of the amplification is carried out in a late phase or at the endpoint of amplification. As an endpoint amplification, endpoint PCR is preferred.

In a further preferred embodiment of the method, at least a part of the sample is alternately pumped between at least two chambers with different temperatures, so that this part of the sample passes through a thermal cycle.

It is particularly preferred if at least two samples are brought together in an end chamber that is connected to the at least two fluidic pathways of the device. Particularly preferably, the at least two samples are mixed with each other in the end chamber. It is further preferred if a microarray analysis is carried out in the end chamber with the mixed samples.

In such a method, processes can be carried out respectively in the two pathways with the pure, unmixed samples. An additional final analysis of the mixed sample can then be carried out in the end chamber.

In this embodiment, the reaction mixture (i.e. the samples, to which further substances have optionally been added) is preferably pumped back and forth between two (or more) different chambers, i.e. cyclically from a first chamber into a second chamber, from the second chamber into the first chamber, etc. In this process, the reaction mixture can be thermally cyclized by keeping the first and the second chamber at different temperatures. This method can allow particularly rapid thermal cyclization, because only the temperature of the reaction mixture is changed, while the environment, i.e. the microfluidic device and in particular the reaction chambers, can be maintained at (different) constant temperatures. If the reaction mixture were thermally cyclized in an individual reaction chamber, it would also be necessary to cyclize, in addition to the temperature of the reaction mixture, the temperature of the reaction chamber (i.e. in particular of the walls of the reaction chamber) as well. This can be extremely time-consuming.

The chambers involved in thermal cyclization are preferably arranged within the capture area of the detection unit. This makes it possible to carry out an (interim) measurement between individual cycles via the detection unit. (Interim) measurement can also be carried out within a read-out cycle between two thermal cycles. Preferably, the chamber in which the reaction mixture is located in the read-out cycle is externally excited, at least for part of the duration of the read-out cycle (e.g. by means of a laser). In this manner, emission of a fluorescent signal that can be detected by the detection unit can be stimulated.

As a further aspect, a system is presented that comprises a microfluidic device as described above, a detection unit and preferably further an excitation device.

The above-described particular advantages and design features of the microfluidic device and the method are applicable and transferable to the described system.

BRIEF DESCRIPTION OF THE DRAWINGS

The disclosure and its technical environment are described below in further detail with reference to the figures. The figures show particularly preferred examples to which, however, the disclosure is not limited. In particular, it should be noted that the figures and in particular the size relations shown therein are solely diagrammatic in nature. The figures are schematic diagrams of the following.

DETAILED DESCRIPTION

Figure 1:
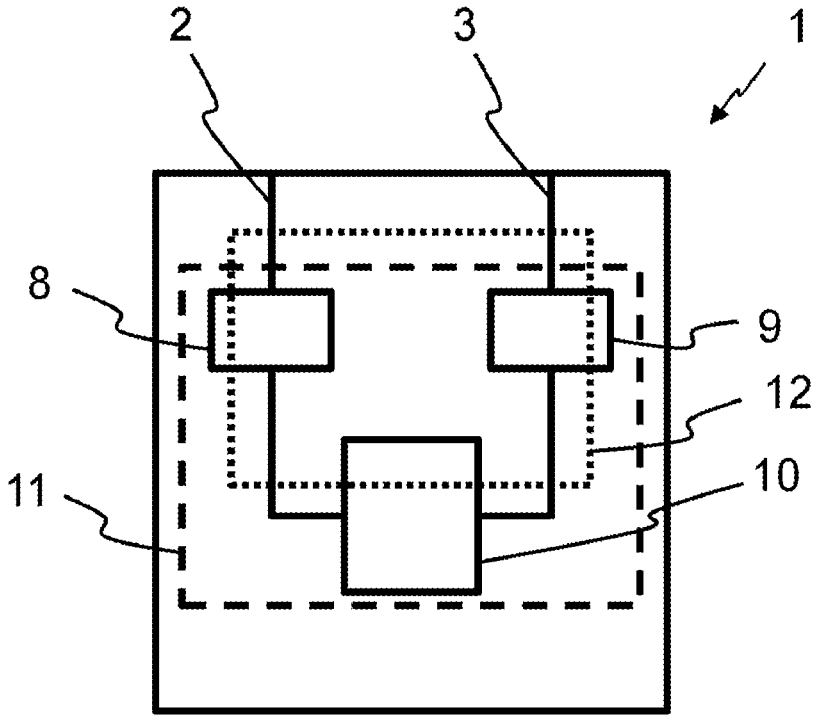
FIG. 1: a microfluidic device for analyzing samples.

FIG. 1 shows a sectional view of a microfluidic device 1 for analyzing samples. The microfluidic device 1 comprises a first fluidic pathway 2 and a second fluidic pathway 3 for receiving samples. In addition, the microfluidic device 1 comprises a capture area 11 for a detection unit 4 for measuring light (shown in FIG. 2) that is configured to capture light emitted by samples in the two fluidic pathways 2, 3. The capture area 11 is indicated by broken lines. A first chamber 8 for receiving at least a part of the sample is provided in the first fluidic pathway 2. A second chamber 9 for receiving at least a part of the sample is provided in the second fluidic pathway 3.

The microfluidic device 1 further comprises a coupling area 12 for coupling a stimulus emitted by an excitation device 6 (shown in FIG. 2) into the samples. The coupling area 12 is indicated by dotted lines. The coupling area 12 partially overlaps with the capture area 11.

In addition, the microfluidic device 1 comprises an end chamber 10 that is connected both to the first fluidic pathway 2 and the second fluidic pathway 3.

The microfluidic device 1 can for example be used to first carry out separate processing of two different samples, each containing DNA to be analyzed, in the first fluidic pathway 2 and in the second fluidic pathway 3. For example, (real-time) amplification can be carried out in the first chamber 8 and in the second chamber 9. This can be qualitatively detected by the detection unit 4, because the capture area 11 completely comprises the first chamber 8 and the second chamber 9. After this, the samples can be further processed in the end chamber 10. For this purpose, for example, a microarray can be provided in the end chamber 10. Microarray analysis in the end chamber 10 can also be carried out by the detection unit 4, because the end chamber 10 also lies within the capture area 11. The samples can be excited using the excitation device 6. Excitation can be partially carried out in the first chamber 8, the second chamber 9 and the end chamber 10 respectively, because the coupling area 11 partially comprises each of the respective chambers.

Figure 2:
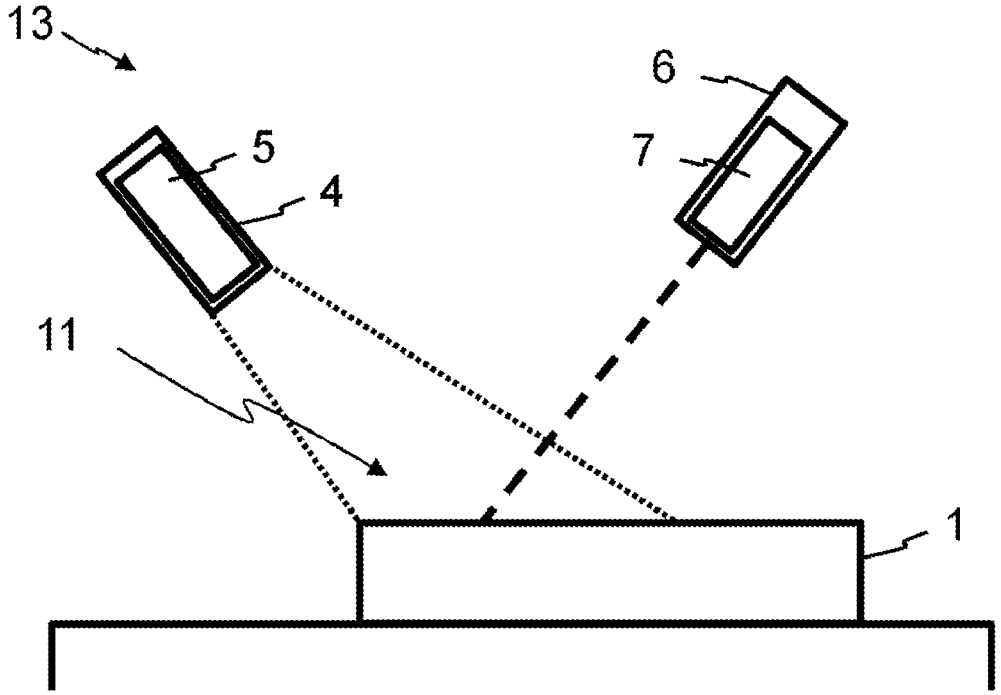
FIG. 2: a system comprising in particular the microfluidic device of FIG. 1.

FIG. 2 shows a system 13 comprising the microfluidic device 1 of FIG. 1, a detection unit 4 and an excitation device 6. The detection unit 4 is configured with a camera 5. The excitation device 6 is configured with a laser 7.

By means of the detection unit 4 or the camera 5, light emitted by samples in the capture area 11 of the microfluidic device can be captured. Dotted lines indicate the area that can be covered by the camera 5. The capture area 11 is configured on the surface of the microfluidic device 1 between the dotted lines.

The excitation device 6 or the laser 7 can act on the microfluidic device 1 or a sample located therein. This is indicated by a broken line. Preferably, the excitation device 6 can be adjusted such that excitation is possible at each location of the (in particular entire) capture area 11. All of the locations on the surface of the microfluidic device 1 that can be reached by the laser 7 together form the coupling area 12 (shown only in FIG. 1). The excitation by means of the excitation device 6 can be carried out for a limited period of time.

The invention claimed is:

1. A method for analyzing samples using a microfluidic device including at least two fluidic pathways configured to receive the samples and at least one capture area for a detection unit, the method comprising:

capturing light emitted from the samples in the at least two fluidic pathways across the at least one capture area with the detection unit; and analyzing nucleic acids in parallel in the at least two fluidic pathways according to at least two different analysis methods in such a way that a different analysis method of the at least two different analysis methods is at least partially simultaneously performed in each of the at least two fluidic pathways.

2. The method as claimed in claim 1, wherein each of the at least two different analysis methods is selected from the following group:

(real-time) amplification, endpoint amplification, melting curve analysis, and microarray analysis.

3. The method as claimed in claim 1, further comprising:

pumping the samples back and forth between at least two chambers, which are at different temperatures, such that of the samples pass through a thermal cycle.

4. The method as claimed in claim 1, further comprising:

combining at least two of the samples in an end chamber connected to the at least two fluidic pathways of the device.

5. The method as claimed in claim 4, further comprising:

analyzing the nucleic acids in the combined at least two samples in the end chamber.

6. The method as claimed in claim 5, wherein the analyzing of the nucleic acids in the combined samples includes performing a microarray analysis in the end chamber.

* * * * *